United States Patent [19]

Rethke

[11] Patent Number: 4,825,575

[45] Date of Patent: May 2, 1989

[54] COLLAPSIBLE SIGNPOST

[75] Inventor: John T. Rethke, King City, Calif.

[73] Assignee: Stake-It Company, King City, Calif.

[21] Appl. No.: 61,325

[22] Filed: Jun. 11, 1987

[51] Int. Cl.[4] ..... G09F 15/00

[52] U.S. Cl. ..... 40/610; 248/533

[58] Field of Search ..... 40/610, 607; 248/166, 248/533, 165

[56] References Cited

U.S. PATENT DOCUMENTS

| | | | |
|---|---|---|---|
| 1,035,575 | 8/1912 | Goode | 248/166 |
| 1,507,195 | 9/1924 | Moore | 40/610 |
| 2,613,463 | 10/1952 | Transue | 40/610 |
| 2,645,440 | 7/1953 | Heistand | 248/533 |
| 2,693,655 | 11/1954 | Tschiedel | 40/610 |
| 2,876,974 | 3/1959 | Liftman | 248/533 |
| 3,231,994 | 2/1966 | Cyrus | 40/610 |
| 3,847,335 | 11/1974 | Ross | 248/166 |
| 4,005,537 | 2/1977 | von Camber et al. | 40/610 |
| 4,071,970 | 2/1978 | Strizki | 40/610 |
| 4,258,494 | 3/1981 | Borgur | 40/607 |
| 4,326,352 | 4/1982 | Barth | 40/607 |

FOREIGN PATENT DOCUMENTS

| | | | |
|---|---|---|---|
| 2710419 | 9/1988 | Fed. Rep. of Germany | 40/610 |

*Primary Examiner*—Paul J. Hirsch

*Attorney, Agent, or Firm*—Schroeder, Davis, Orliss Inc.

[57] ABSTRACT

A portable, collapsible post having at least two sections rotatably coupled together by a pair of hinges in end-to-end fashion. When one of the hinge pins is removed, the sections will rotate about the axis formed by the remaining hinge pin allowing the post to be folded or collapsed reducing the overall length of the post. A cross arm member may also be attached in similar fashion to the upper portion of the post to support one or more signs to be displayed. The post is removeably mounted on a mounting stake driven into the ground and includes an anti-swivel bracket to prevent the post from turning in the wind when so mounted.

5 Claims, 3 Drawing Sheets

COLLAPSIBLE SIGNPOST

BACKGROUND OF THE INVENTION

The present invention relates generally to a signpost for supporting and displaying signs such as real estate signs and the like, and more particularly to a portable cross arm yard sign post which is collapsible.

Cross arm type sign support posts are well known in the prior art and are widely used, particularly in connection with the sale of real estate where it is desired to place a sign on the lawn of a home or the like being advertised. Small, lightweight portable sign supports typically constructed of metal tubing are also used, but are not of sufficient size and are rather unattractive. When the signs are no longer required, the sign and its support post are removed and reused. When using wooden posts, it is customary in many areas, to pay a sign installer to install and remove the sign posts.

It is desirable to provide a large, attractive sign support post, such as a 4×4 wood post, having the capability to support a large sign plus an additional rider sign. Such wooden posts are difficult to transport because of their overall size and further require that a hole be dug in the ground for installation. Often there are problems digging or drilling the hole, particularly in winter or in areas where the earth is dry or rocky.

U.S. Pat. No. 4,326,352 entitled "Sign Post" issued to Duane D. Barth on Apr. 27, 1982 discloses a sign post having a cross arm assembly which is transported as a disassembled kit and is then assembled at the installation site and mounted on a metal stake which has been driven into the ground. Barth provides a hollow post, a cross member assembly and a hollow post cap. The several elements are assembled by placing the post, cross member and cap over the stake after it has been driven into the ground.

SUMMARY OF THE INVENTION

The present invention comprises a two-piece post hingedly coupled together, end-to-end, and a cross arm hingedly attached near one end of the post to extend normally from the post. The other end of the post opposite from the cross arm includes a hole bored lengthwise into the post having a metal sleeve insert to allow the post to be disposed in an upright, vertical orientation when placed on a metal stake which has been driven into the ground.

In the preferred embodiment, the two sections of the post are rigidly coupled together, end-to-end, by a pair of hinges having removable hinge pins. When the hinge pin is removed from one of the hinges, one of the post sections may be rotated 180 degrees into an adjacent and parallel position with the other post section thus allowing the post to be folded or collapsed into a more convenient length. Similarly, the cross arm member is rigidly coupled by a pair of hinges to the side of the post near the top such that the cross arm member extends normally from the side of the post. When the hinge pin is removed from the top hinge, the cross arm member may be rotated 90 degrees downwardly into an adjacent and parallel position with the post section the cross arm member is attached to. Thus folded, the sign support post forms a compact, relatively short assembly which may be easily and safely transported in the trunk of an automobile, for example, and conveniently stored.

The sign support post of the present invention is particularly useful in the field of real estate. The use of wood for the post material provides the natural attractiveness of wood and wood is inexpensive and readily available. The beauty of the color, grain and texture of the wood may be preserved by the use of natural stains, or, alternatively, the post may be painted to provide whatever color post is desired. There is no hole to be dug or drilled and, consequently, no damage to the lawn or bottom rotting of the post. The mounting stake is easily driven into and removed from all types of soil and may even be driven through asphalt or into frozen ground. Since a relatively long length of stake is driven into the ground, the sign support post is particularly stable in wet earth and is not likely to be blown down in heavy winds.

DETAILED DESCRIPTION OF THE PREFERRED EMBODIMENT

Figure 1:
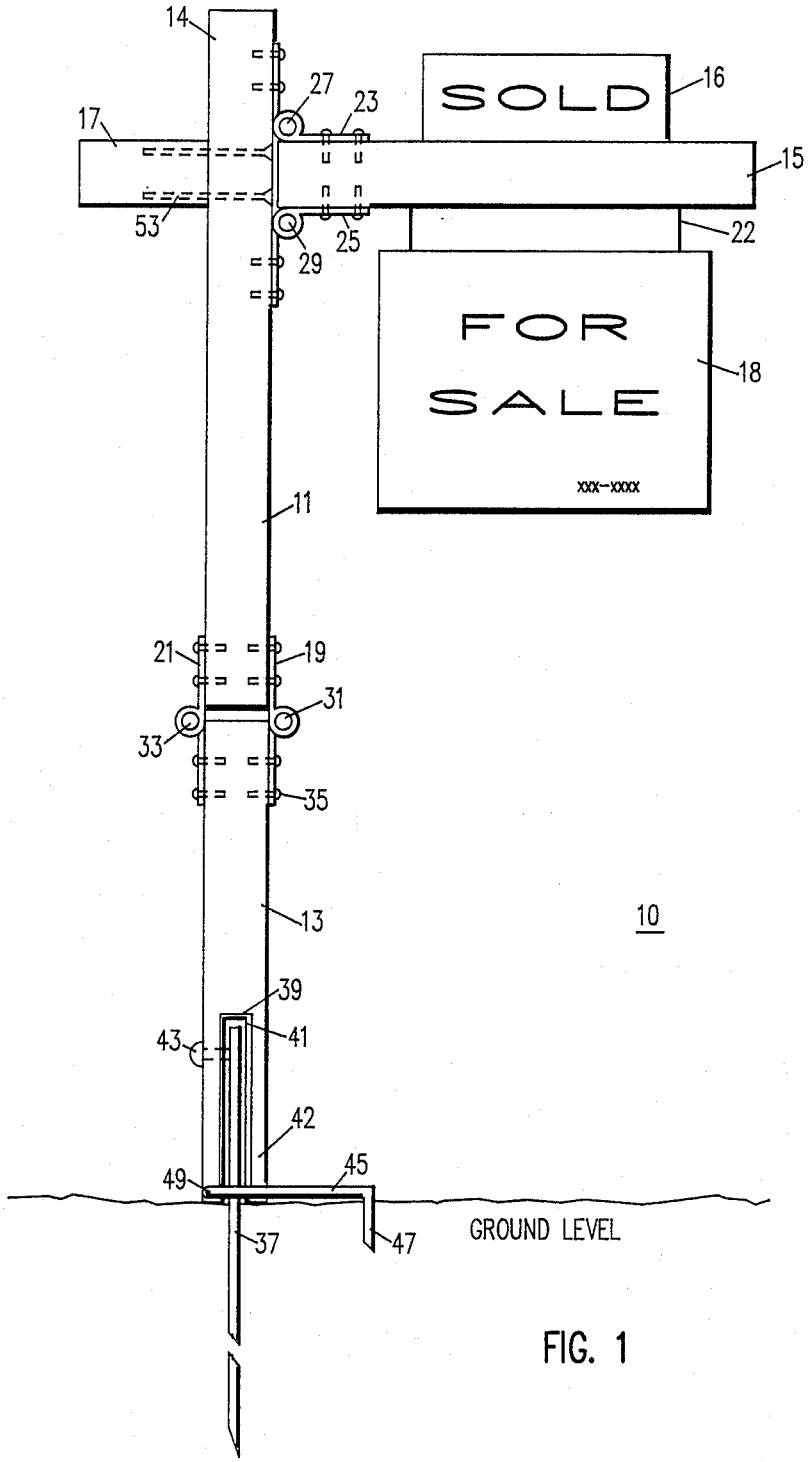
FIG. 1 is a perspective view of the sign support post of the present invention.

Referring now to the drawings wherein like reference numerals designate identical or corresponding parts throughout the several views, and more particularly to FIG. 1, the present invention, a collapsible post and more particularly a collapsible sign support post, is designated generally as 10.

The collapsible post 10 is comprised of top post section 11 and bottom post section 13 hingedly coupled together, end-to-end, by hinges 19 and 21 having removeable hinge pins 31 and 33, respectively. A cross arm member 15 may be hingedly coupled to the side of the top post section 11 near the top 14 in such a manner that it extends normally to the side of the post 10. Top hinge 23 and bottom hinge 25 having removeable hinge pins 27 and 29, respectively, rigidly support the cross arm member 15 in position. To balance the appearance of the sign post 10 a short cross arm extension 17 may be attached with wood screws or lag bolts 52 to the top post section 11 opposite the cross arm member 15. The post sections 11, 13 and the cross arm members 15, 17 are preferably constructed of 4×4 inch dimensioned wood, but may be fabricated from any suitable material such as metal tubing, the only requirement being that hinge mounting surfaces are provided on opposite sides of the post sections 11, 13 and cross arm member 15.

Top hinge 23 and side hinge 19 are 3 inch hinges having remove able hinge pins 27, 31, respectively, and bottom hinge 25 and side hinge 21 are 3 inch door hinges, although any suitable hinges may be utilized, the only requirement being that top hinge 23 and side hinge 19, at least, have removeable hinge pins 27, 31. It is not required that the bottom hinge 25 and side hinge 21 have removeable hinge pins 29, 33, respectively, to practice the invention. However, if all four hinges, 19, 21, 23 and 25 have removeable hinge pins, the sign support post 10 may be easily disassembled if desired rather than merely folded or collapsed. The hinges are secured to the post sections 11, 13 and the cross arm member 15 by screws or bolts 35 having the hinge pins located at the break between the post sections 11, 13 and at the joint between the top post section 11 and the cross arm member 15.

Cross arm member 15 is provided with a means 22, such as hook and eye assemblies or short lengths of light chain, to suspend a large sign 18 from its lower side. The top of cross arm member 15 is provided with a lengthwise slot (not shown) to facilitate placing a rider sign 16 to provide information additional to that provided by sign 18.

Collapsible post 10 includes an elongated metal mounting stake 37 having a substantially smaller cross-sectional dimension than post 10 and is shaped for easy insertion into the earth. Mounting stake 37 may include a triangular-shaped plate (not shown) attached to its lower end to prevent any rotation of the stake 37 when implanted in the earth. Mounting stake 37 is driven into the earth using well-known means such as a slide hammer or a wooden mallet (not shown). Use of a metal sledge hammer or similar tool will cause the top of the mounting stake 37 to mushroom. When the post 10 is no longer required, mounting stake 37 may be easily removed by any of several well-known post pullers (not shown). Mounting stake 37 is approximately 36 inches long and, when properly installed, will have about 6 inches protruding above ground level for mounting the post 10.

The base 42 of the support post 10 is provided with lengthwise bore 39 for receiving the mounting stake 37. Bore 39 may have a metal liner or sleeve 41, such as a length of steel pipe, to preserve the dimensions of the bore 39 and prevent deterioration of the wood or other base material. The bore 39 (including sleeve 41) has a cross-sectional dimension slightly larger than the mounting stake 37 to provide a snug fit when the mounting stake 37 is inserted into bore 39. A threaded hole is bored through the side of the base 42 into bore 39 to receive set screw 43. When the post 19 is mounted in an upright, vertical position with the mounted stake 31 inserted in bore 39, set screw 43 may be tightened with an allen wrench or other suitable tool to protrude through sleeve 41 against mounting stake 37 to securely hold the post 10 in position on mounting stake 37 thereby preventing theft of the sign support post 10 and minimizing any tendency of the sign support post 10 to rotate about its longitudinal axis due to wind.

An anti-swivel bracket 45 comprises a U-shaped metal arm 45 rotatably mounted to the base 42 by pin 49 and a pair of metal spikes 47 rigidly attached to the arm 45. When the post 10 is mounted in an upright position on mounting stake 37, arm 45 is rotated about pin 49 until spikes 47 are in a downwardly pointing position just touching the ground. The spikes 47 are then driven into the ground until the arm 45 is parallel to the ground (as shown in FIG. 1). Thus positioned, the anti-swivel bracket 45 will maintain the post 10 in any desired position and prevent rotation of the post due to wind.

Figure 2:
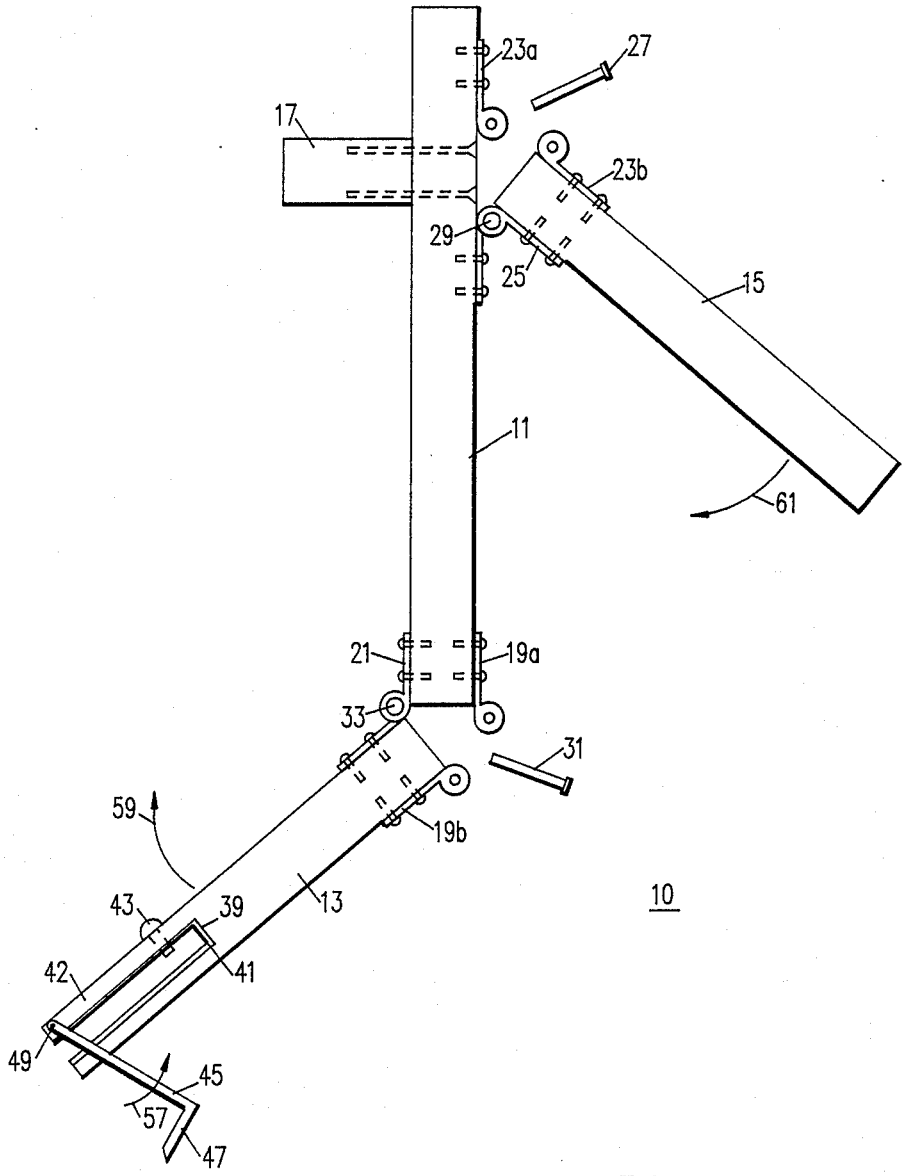
FIG. 2 is a perspective view of the sign support post of FIG. 1 in partially collapsed configuration.
Figure 3:
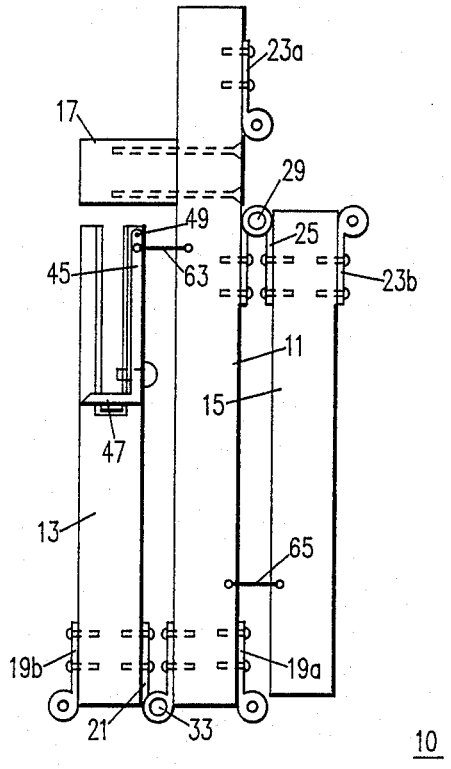
FIG. 3 is a perspective view of the sign support post of FIG. 1 in collapsed configuration.

Referring now also to FIGS. 2 and 3, collapsible post 10 is shown in partially collapsed and full collapsed, respectively, configurations. To collapse the post 10, hinge pin 31 is removed from hinge 19 separating the hinge into its component hinge plates 19*a* and 19*b*. Bottom post section 13 is then rotated clockwise, as shown by arrow 59, 180 degrees to a position adjacent and parallel to top post section 11 (as shown in FIG. 3). Hinge pin 27 is then removed from the top hinge 23 separating the hinge into hinge plates 23*a* and 23*b*. The cross arm member 15 is then rotated 90 degrees clockwise, as indicated by arrow 61,to a position adjacent and parallel to top post section 11 (as shown in FIG. 3). Anti-swivel bracket arm 45 and spikes 47 are rotated counter-clockwise about pin 49 as indicated by arrow 57 to a closed position against bottom post section 13 (as shown in FIG. 3). Hook and eye assemblies 63 and 65 may be provided to lock and maintain the collapsible post 10 in a fully collapsed configuration while being stored or transported.

To set up the sign support post, the post 10 is transported to the desired site in the collapsed configuration. At the desired site, the bottom post section 13 and the cross arm member 15 are unfolded in opposite order to the folding or collapsing procedure described herein above. The hinge pins 27 and 31 are installed in top hinge 23 and side hinge 19, respectively, rigidly securing the cross arm member 15 and the bottom post section 13 in place. Mounting stake 37 is then driven into the ground at the desired location to a depth which leaves approximately 6 inches of the mounting stake 37 protruding above ground level. Post 10 is then set on top of the mounting stake 37 so that the mounting stake slides up into the bore 39 at the base 42 of the post thereby holding the post in an upright, vertical position. Rotate the post 10 to a desired position to best display the signs 18 and 16 and then rotate the anti-swivel bracket 45 clockwise from its closed position against the bottom post section 13 so that the two spikes 47 penetrate the ground preventing the post 10 from rotating. Set screw 43 is then tightened against the mounting stake 37 to securely retain the post 10 in position.

Numerous characteristics and advantages of the invention have been set forth in the foregoing description, together with details of the structure and function of the invention. The disclosure, however, is illustrative only, and it will be understood by those skilled in the art that various changes and modifications may be made therein without departing from the spirit and scope of the invention as defined in the appended claims.

I claim:

1. A collapsible post comprising:

at least two post sections joined end-to-end to form a rigid straight post, each of said post sections having an upper and a lower end; and at least one pair of hinges, each hinge of said pair of hinges having a first hinge plate and a second hinge plate coupled together by a hinge pin, said first hinge plate attached to the lower end of a first post section, said second hinge plate attached to the upper end of a second post section, each hinge of said pair of hinges so mounted at opposing ends of said first and second post sections on opposite surfaces of said collapsible post, each of said hinge pins disposed at the joint between said first and second post sections, thereby joining said first and second post sections in a rigid, straight configuration with the lower end of said first post section abutting the upper end of said second post section, the hinge pin of one of said hinges being removable, said first and second post sections being rotatable about an axis formed by the other hinge pin when said removable hinge pin is removed.

2. A portable, collapsible sing support post comprising:

at least two post sections joined end-to-end forming a rigid straight post, said post having a top and a bottom post section, each post section having an upper and a lower end;

a first pair of hinges, each hinge of said first pair of hinges having first and second hinge plates rotatably coupled together by a hinge pin, at least one hinge of said first pair of hinges having a removable hinge pin, said first pair of hinges coupling two of said post sections together forming a rigid straight post when said removable hinge pin is installed with the upper end of one post section abutting the lower end of the other post section, said two post sections rotatable about a first axis formed by the other hinge pin normal to the longitudinal axis of the post when said removable hinge pin is removed;

at least one cross arm member attached at one end to said top post section near the upper end of said top post section, said cross arm member extending outwardly from said top post section normal to said top post section, and a second pair of hinges, each hinge of said second pair of hinges having first and second hinge plates rotatably coupled together by a hinge pin, at least one hinge of said second pair of hinges having a removable hinge pin, said second pair of hinges rigidly attaching said cross arm member to said top post section with said one end abutting the side of said top post section when said removable hinge pin is installed, said cross arm member rotatably attached to said top post section when said removable hinge pin is removed, said cross arm member rotatable about a second axis formed by the other hinge pin normal to the longitudinal axis of the post and the cross arm member when said removable hinge pin is removed.

3. A sign support post as in claim 2 further comprising:

an elongated mounting stake; and said bottom post section having a bore extending lengthwise into its lower end a predetermined length, said bore including sleeve means inserted in said bore, said sleeve means for receiving said mounting stake and minimizing wear of said bore, said sign support post supported in an upright, vertically-disposed orientation when mounted on said mounting stake and said mounting stake is inserted in the earth.

4. A sign support post as in claim 3 further including a cross arm extension member rigidly attached to and extending outwardly normal to said top post section, said cross arm extension member disposed in opposing relationship to said cross arm member.

5. A sign support post as in claim 3 further comprising an anti-swivel bracket rotatably attached to the lower end of said bottom post section, said anti-swivel bracket rotatable in the plane of said sign support post about an attachment pin for insertion of a free end of said anti-swivel bracket into the earth preventing rotation of said sign support post about its longitudinal axis when mounted on said mounting stake.

* * * * *